United States Patent [19]

Knell et al.

[11] 4,298,052

[45] Nov. 3, 1981

[54] CONTINUOUS CASTING INSTALLATION CONTAINING OPEN-ENDED MOLD

[75] Inventors: Bernhard Knell, Thalwil; Adalbert Röhrig, Wädenswil, both of Switzerland

[73] Assignee: Concast AG, Zürich, Switzerland

[21] Appl. No.: 83,980

[22] Filed: Oct. 11, 1979

[30] Foreign Application Priority Data

Oct. 27, 1978 [CH] Switzerland ..... 11114/78

[51] Int. Cl.[3] ..... B22D 11/04; B22D 11/12

[52] U.S. Cl. ..... 164/416; 164/442; 164/448

[58] Field of Search ..... 164/83, 442, 441, 447, 164/448, 416

[56] References Cited

U.S. PATENT DOCUMENTS 3,779,303 12/1973 Pietryka ..... 164/416
3,794,107 2/1974 Bollig et al. ..... 164/442
3,822,738 7/1974 Rotarides et al. ..... 164/83 X

*Primary Examiner*—Gus T. Hampilos
*Attorney, Agent, or Firm*—Werner W. Kleeman

[57] ABSTRACT

In order to improve disassembly of the oscillation mechanism at a continuous casting installation, the continuous casting mold and the first support guide zone, and at the same time to obtain a support guide arrangement free of dislocation at the transition location, an upper section of the machine base frame and a support frame for the mold and the first zone of the support guide arrangement are at least partially overlappingly arranged. The underside of the frames are supported upon a foundation which is common to such frames. The upper section or portion of the machine base frame at its upper end region and the support frame for the continuous casting mold are movably supported in the direction of travel of the continuously cast strand at a common support location.

6 Claims, 3 Drawing Figures

CONTINUOUS CASTING INSTALLATION CONTAINING OPEN-ENDED MOLD

BACKGROUND OF THE INVENTION

The present invention relates to the continuous casting art and, more specifically, concerns a new and improved construction of a continuous casting installation containing an oscillating open-ended mold—also referred to as an oscillating continuous casting mold—and an at least partially curved support guide arrangement for the continuously cast strand. The support guide or roller apron, following a first zone of the support guide or roller apron arrangement, is attached to a machine base frame.

It is known in the continuous casting art to secure the continuous casting mold, by means of two parallel guide elements, at a support of the casting platform structure and to connect the support guide, following the continuous casting mold, with another support of the casting platform structure. Depending upon loading of the casting platform by tundish carriages, ladle carriages and so forth, there are possible elastic deformations at the casting platform structure. Due to irregular heating of individual structural components, during the continuous casting operation, there can additionally arise irregular expansion of such parts of components. The mentioned deformations and expansions can lead to dislocation of the support guide elements or segments along the strand guide track, especially between the mold and the first zone of the support guide arrangement, which, in turn, can lead to flaws or defects in the continuously cast strand.

Also with another state-of-the-art continuous casting installation it is known to define the oscillation path of the mold by means of guide elements or links secured at the machine base frame, at least one of the guide elements or links is connected with an oscillation drive. The non-oscillating first zone of the support guide arrangement, directly following the continuous casting mold, is retained by a support or carrier fixed to the machine base frame and is slidingly guided in relation to the continuous casting mold. The support guide following the first zone likewise is fixed at the machine base frame. With this continuous casting installation the mold and the first zone can be upwardly disassembled. Repair work at the movable parts of the oscillation mechanism, such as the bearings of the guide levers or mold saddle, must be accomplished at the continuous casting installation itself or by removing a number of bearing bolts of the guide elements or links which govern the oscillation movement. Such work is both time consuming and increases the downtimes of such continuous casting installation.

SUMMARY OF THE INVENTION

Therefore, with the foregoing in mind it is a primary object of the present invention to provide a new and improved continuous casting installation equipped with a continuous casting mold, which is not afflicted with the aforementioned drawbacks and shortcomings of the prior art proposals.

Another and more specific object of the present invention aims at overcoming the aforementioned drawbacks at a continuous casting installation, and wherein both individual machine parts, such as the mold, with or without the first support guide zone, and also an entire machine group or assembly, composed of the continuous casting mold, first strand support guide zone, mold table and oscillation support, can be rapidly disassembled and reassembled as a complete unit.

Yet a further significant object of the present invention is to ensure that such continuous casting installation is in exact alignment at the transition locations between the continuous casting mold and the first zone and between the first zone and the subsequent zone, both during the hot and cold operating states of the continuous casting installation or machine.

Now in order to implement these and still further objects of the invention which will become more readily apparent as the description proceeds, the continuous casting installation of the present development is manifested by the features that an upper portion of the machine base frame and a support frame for the continuous casting mold and the first zone of the strand support guide arrangement are arranged to be at least partially overlapping and are supported at their underside, each individually, upon a foundation which is common to both. Further, the upper portion or section of the machine base frame, at its upper end region, and the support frame for the continuous casting mold, are movably supported at a common support location in the direction of travel of the strand.

The continuous casting installation, in the event of a malfunction or disturbance, such as for instance metal break-out, enables removal of the continuous casting mold with or without the first strand support zone. Without any appreciable additional work it is possible, however, when necessary, to also dismantle all elements of the oscillation mechanism and the mold table and to carry out the revision work at the workshop or other repair location. When there is available appropriate exchange equipment then the repair work can be accomplished at the oscillation mechanism without any appreciable downtime of the equipment. A further advantage of this construction resides in the fact that the clearly defined attachment point, and equally the support frame for the mold and the first zone, as well as also the upper portion of the machine base frame, afford dislocation-free transitions at the strand guide or roller apron arrangement, so that such continuous casting installations for strands also are suitable for casting sensitive steels.

The supporting action at the common support location can be selected in different ways. A preferred solution, according to one aspect of the invention, contemplates that the upper portion or section of the machine base frame is connected, at its upper end region, with the support frame for the continuous casting mold by means of sliding block guides movable in the direction of strand travel, and further, that the common support location is provided with further sliding block guides arranged at the upwardly extended foundation. The upper portion of the machine base frame or machine frame can be thus indirectly supported, by means of the support frame, at the common support location.

Another preferred solution can be realized, in accordance with the invention, if the upper portion of the machine base frame is supported at its upper end region, and independently thereof, the support frame for the continuous casting mold is supported, by means of anchor rods or equivalent structure at the common support location which is upwardly extended at the foundation. Although the hinge connection of the anchor rods at the upper portion of the machine base frame and the support frame, respectively, carry out, during an extension or shortening thereof, a rocking or pivotable movement, the deviations from a linear movement parallel to the strand direction of travel in the existing movement range is insignificant in practice.

The upper portion of the machine base frame and the support frame can be individually directly supported at a concrete foundation. According to a further advantageous proposal of the invention it is contemplated that, the upper portion of the machine base frame and the support frame for the mold are pivotably supported at the foundation by means of shafts or axles arranged at their underside, transverse to the direction of strand travel, and parallel to the curved support surfaces of the strand guide track.

A further construction of the invention recommends arranging in mutual alignment with one another the pivot shafts or axles provided at the upper portion of the machine base frame and at the support frame as foundation elements. However, it is also possible to connect such aligned shafts and to provide such as a continuous shaft for both frame parts. The arrangement of a common pivot shaft constitutes an economical and precise solution for a foundation structure. Instead of a direct arrangement of the pivot shaft at the foundation it can advantageously be indirectly supported at the foundation by means of the machine base frame.

When using the constructional embodiment employing anchor rods, it is a further proposal of the invention to hingedly connect such at their two ends and to arrange them approximately at the same elevation or height. In this way there is produced a static, clealy defined holding or support system possessing extreme accuracy.

BRIEF DESCRIPTION OF THE DRAWINGS

The invention will be better understood and objects other than those set forth above will become more apparent when consideration is given to the following detailed description thereof. Such description makes reference to the annexed drawings wherein.

DETAILED DESCRIPTION OF THE PREFERRED EMBODIMENTS

Figure 1:
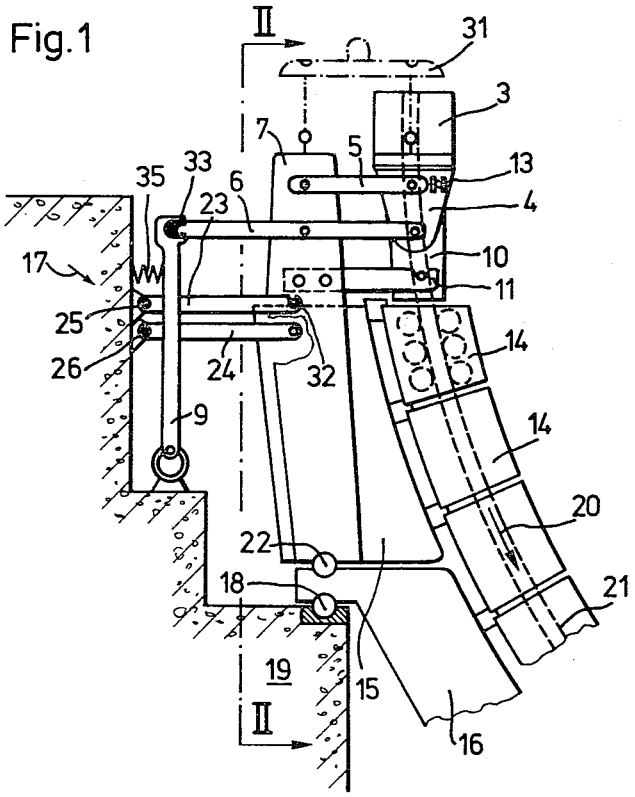
FIG. 1 is a side view of a partially illustrated continuous casting installation.
Figure 2:
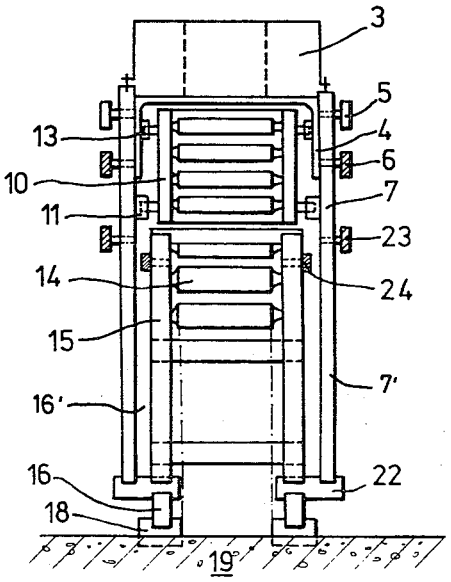
FIG. 2 is a cross-sectional view of the continuous casting installation shown in FIG. 1, taken substantially along the line II—II thereof.

Describing now the drawings, it is to be understood that only enough of the construction of the continuous casting installation has been shown to enable those skilled in the art to readily understand the underlying principles and concepts of the invention. Turning attention now to FIGS. 1 and 2, reference character 3 designates an oscillating continuous casting mold of a continuous casting installation for the casting of steel. This open-ended or continuous casting mold 3 is seated upon a mold table 4. The mold table 4 is connected at each side by means of two guides or links 5 and 6, with a support frame 7 for the continuous casting mold, mounted at the outside of the curved strand support guide arrangement or roller apron arrangement, and a first zone 10 of such support guide arrangement. The oscillation path of the continuous casting mold 3 is governed by the pivotal movement of the guide or link elements 5 and 6. The guide or link element 6 is connected, by means of an extended portion, with a drive lever 9 of the oscillation drive.

The first, stationary support guide zone or roller apron 10 is suspended, directly following the continuous casting mold 3, by means of the supports or carriers 11 at the support frame 7 and is guided, by means of sliding guides 13 mounted at the mold table 4, in relation to the continuous casting mold 3. The support guide segments or roller aprons 14, following the first support guide zone 10, are attached at an upper portion or section 15 of a machine base frame 16 or at the machine base frame 16 itself. This machine base frame 16 is supported, by means of the axles or shafts 18, upon a foundation 19. The support frame 7 and machine base frame 16 each consist of two mutually interconnected side plates or cheeks 7' and 16'.

The support frame 7 and the upper portion 15 of the machine base frame or machine frame 16 are likewise pivotably supported upon a respective shaft 22 arranged transversely with respect to the direction of travel 20 of the continuously cast strand and parallel to the curved support surface of a strand guide track or path 21. It is immaterial as far as the invention is concerned whether the support frame 7 and the upper portion or section 15 of the machine base frame 16 bear directly or indirectly, by means of the machine base frame 16, at the foundation 19. The shafts or axles 22, in the embodiment under discussion, are provided as continuous shafts for the support frame 7 and for the upper portion or section 15 of the machine base frame 16. Yet, it is conceivable to also provide separate shafts for the support frame 7 and the upper portion 15 of the machine base frame 16, these separate shafts being arranged to be essentially in alignment with one another. Instead of using the shafts or axles 22 it would be also possible to employ other rigid or pivotal support devices.

Anchor rods 23 connect the support frame 7, and anchor rods 24 the upper portion 15 of the machine base frame 16, with a common support location having support points or hinge means 25 and 26 which are upwardly directed from the foundation 19. The support frame 7 and the upper portion 15 of the machine base frame 16 are therefore mutually independently interconnected with the foundation 19.

The guide or link elements 5 and 6 are mounted at the outside of the curved or arc-shaped support guide arrangement. However, it is also possible to arrange the support frame 7 and the upper portion 15 of the machine base frame 16 at the inside of the arcuate-shaped support guide or roller apron arrangement. It is optionally possible to employ this guide concept both for the oscillation movement of the continuous casting mold and also, however, in the case of straight continuous casting molds which are followed by only partially curved strand guide arrangements. Instead of the oscillation guide by means of the guide or link elements 5 and 6, as shown in the embodiment under discussion, it would also be possible to employ other known oscillation guides and oscillation drives.

The concept of the mutual independent three point-attachment arrangement both of the support frame 7 and also the upper portion 15 of the machine base frame 16 can be particularly advantageously realized if the anchor rods 23 and 24 are hingedly connected at both of their ends. To simplify the illustration and to improve the clarity of the showing of the drawings, the anchor rods 23 and 24 have been shown arranged below one another in the individual figures of the drawings. However, it is advantageous to attach all of the anchor rods 23 and 24 at support points of the same elevation or height.

The support points or hinge means 25 and 26, mounted at the upwardly extended foundation 19, also can be secured at an appropriately sturdy, vertical support carrier of the machine or hall structure. What is important is that all of the anchor rods are hingedly connected at the common support location 17, so that with any shifting of the support location 17 or the support points 25 and 26, there does not arise therebetween any relative movement.

During repair work or change in the sectional shape of the cast strand it is possible to optionally exchange the continuous casting mold 3, the first zone 10, the mold table 4 or support frame 7 as an entire exchangeable unit or as individual exchangeable parts. Also, it is possible to collectively dismantle and again assemble only the continuous casting mold 3 and the first zone 10. In order to dismantle the entire exchangeable unit there can be advantageously used a crane hook 31 or any other suitable hoisting structure. The anchor or tie rods 23 and the guide element 6 are appropriately structured at their ends for the rapid coupling and decoupling of the connection bolts 32 and 33, respectively. The oscillation lever 9 is retained in its work position, for instance by a spring 35. During decoupling of the bolt 33 it is possible, by means of a not particularly illustrated force applying device, to exert a force or pressure against the force of the spring 35. A common exchange of the aforementioned parts by means of the crane hook 31 can be accomplished, for instance, within about three to five hours as a general rule.

Figure 3:
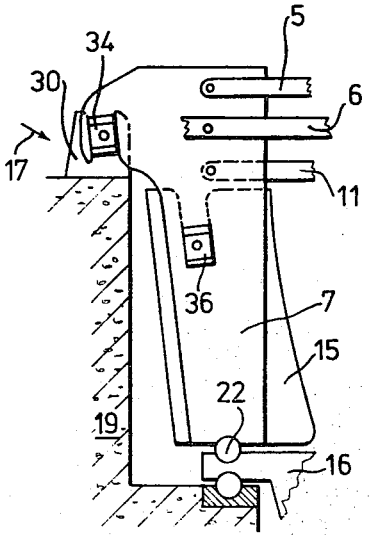
FIG. 3 is a side view of a further embodiment of an only partially illustrated continuous casting installation for strands.

In FIG. 3 there is shown a further exemplary embodiment of an attachment of the upper portion 15 of the machine base frame 16 at the upper end region and the support frame 7 for the continuous casting mold 3 at the common support location 17. To improve clarity in illustration there have been conveniently omitted from the showing of FIG. 3 the mold, first support guide zone and support guide segments.

The common support location 17 comprises a console or bracket 30 mounted at the upwardly extended foundation 19 or at a steel frame. Hingedly connected with the console or bracket 30 is a slide block 34. This slide block 34 coacts with the support frame 7, so that such can freely expand and contract between its two attachment points in the presence of temperature fluctuations or changes. By virtue of the provision of slide block 34 both of the frames 7 and 15 are moveable in the direction of travel of the strand at the common support location 17 and are supported free of play transversely with respect to the strand direction of travel. The upper portion 15 of the machine base frame 16 is thus indirectly supported via the support frame 7 by means of a further slide block guide 36 at the common support location 17. Also the slide block guide 36 permits an elongation or expansion movement in the strand direction of travel.

The support frame 7 as a general rule is longer than the upper portion 15 of the machine base frame 16 and overlies, with a part of its length, the upper portion 15. Normally, this overlying relationship for the upper portion 15 is throughout its entire length.

At its underside both of the frames 7 and 15 are each individually supported upon a foundation 19 which is common to both frames 7 and 15, and the shafts or axles 22 are to be considered as foundation elements or parts, although in the illustrated example they bear upon the machine base frame 16. The frame elements 7 and 15 also could be directly supported at the concrete foundation 19.

The suspension of the continuous casting mold 3 and the first zone 10 of the support guide or roller apron arrangement at the support frame 7 and the arrangement of the oscillation guide as well as the drive for the oscillation movement can also be realized with other known solutions available from existing technology in the continuous casting art.

While there are shown and described present preferred embodiments of the invention, it is to be distinctly understood that the invention is not limited thereto, but may be otherwise variously embodied and prectised within the scope of the following claims. ACCORDINGLY,

What we claim is:

1. A continuous casting installation for casting molten steel to form a continuously cast strand moving in a predetermined direction of travel, comprising:

an oscillating continuous casting mold;

at least a partially curved support guide arrangement following the mold in the casting direction for supporting a partially solidified strand;

said support guide arrangement being divided into a first support structure directly beneath the mold and a subsequent support structure being further divided into exchangeable upper and lower segments;

a support frame carrying said mold and said first support structure of said support guide arrangement;

a machine base frame having an upper portion, said upper portion carrying a plurality of said exchangeable upper segments;

said machine base frame carrying a plurality of said exchangeable lower segments;

said support frame, said upper portion of said machine base frame and said machine base frame each being supported at a common location for independent movement relative to each other;

said support frame and said upper portion of said machine base frame being separately supported by a common foundation at about the same height, said upper portion of said machine base frame extending along a portion of the length of said support frame; and said upper portion of said machine base frame and said support frame being movably supported by said foundation so that independent heat expansion of each of said frames in the direction of strand travel is allowed.

2. The continuous casting installation as defined in claim 1, further including:

slide block-guide means, movable substantially in the direction of travel of the strand, for connecting the upper portion of the machine base frame at its upper end region with the support frame for the continuous casting mold; and said means defining said common support location comprising further slide block-guide means arranged at an outwardly extended portion of said foundation.

3. The continuous casting installation as defined in claim 1, further including:

anchor rod means for supporting the upper portion of the machine base frame at an upper end region and independently thereof the support frame of continuous casting mold at the common support location; and said common support location being arranged at an upwardly extended portion of the foundation.

4. The continuous casting installation as defined in claim 3, further including:

means for hingedly securing the anchor rod means at both of their ends and approximately at the same elevation.

5. The continuous casting installation as defined in claim 1, wherein:

said means for separately supporting the machine base frame and the mold support frame comprises pivot shaft means arranged transversely with respect to the direction of travel of the continuously cast strand and essentially parallel to curved support surfaces of a strand guide track defined by said subsequent support guide portion; and said upper portion of the machine base frame and the support frame of the continuous casting mold being pivotably supported at their underside by said pivot shaft means at the foundation.

6. The continuous casting installation as defined in claim 5, wherein:

said pivot shaft means provided at the upper portion of the machine base frame and at the support frame are arranged to be in alignment with one another.

* * * * *